US011703205B2

(12) United States Patent
Li

(10) Patent No.: US 11,703,205 B2
(45) Date of Patent: Jul. 18, 2023

(54) ANGLE-ADJUSTED LAMP

(71) Applicant: Xiamen Longstar Lighting Co., Ltd., Fujian (CN)

(72) Inventor: Xilong Li, Fujian (CN)

(73) Assignee: Xiamen Longstar Lighting Co., Ltd., Fujian (CN)

( * ) Notice: Subject to any disclaimer, the term of this patent is extended or adjusted under 35 U.S.C. 154(b) by 0 days.

(21) Appl. No.: 17/881,164

(22) Filed: Aug. 4, 2022

(65) Prior Publication Data

US 2022/0373166 A1 Nov. 24, 2022

Related U.S. Application Data

(63) Continuation of application No. PCT/CN2021/077260, filed on Feb. 22, 2021.

(30) Foreign Application Priority Data

Feb. 25, 2020 (CN) ..... 202020206221.5

(51) Int. Cl.
*F21V 1/14* (2006.01)
*F21V 1/16* (2018.01)
(Continued)

(52) U.S. Cl.
CPC ..... *F21V 1/143* (2013.01); *F21V 1/16* (2013.01); *F21V 14/02* (2013.01); *F21V 21/30* (2013.01);
(Continued)

(58) Field of Classification Search
CPC . F21V 1/143; F21V 1/16; F21V 14/02; F21V 21/30; F21V 29/83; F21W 2121/00; F21Y 2115/10; F21S 8/04
See application file for complete search history.

(56) References Cited

U.S. PATENT DOCUMENTS

2014/0126213 A1* 5/2014 Pattekar ..... F21V 29/83 362/294

FOREIGN PATENT DOCUMENTS

CN 101520145 A 9/2009
CN 208487467 U 2/2019
(Continued)

OTHER PUBLICATIONS

English Translation, KR 101405571, Jun. 10, 2014; Hwang (Year: 2014).*

(Continued)

*Primary Examiner* — Peggy A Neils
(74) *Attorney, Agent, or Firm* — Cooper Legal Group, LLC

(57) ABSTRACT

An angle-adjustable lamp comprises a lamp body, a plurality of heat sinks, a plurality of connecting rods, and a plurality of light-transmitting covers. The plurality of heat sinks are rotatably connected to a side wall of the lamp body respectively through the plurality of connecting rods. The plurality of heat sinks are rotationally symmetrically disposed around a longitudinal center axis of the lamp body. Each of the plurality of light-transmitting covers is disposed on a side of a corresponding one of the plurality of heat sinks facing away from the lamp body. When the plurality of heat sinks are rotated around the plurality of connecting rods, an angle between each of the plurality of light-transmitting covers and the lamp body is correspondingly changed, so that a light exit angle of light transmitted through each of the plurality of light-transmitting covers is correspondingly changed.

5 Claims, 5 Drawing Sheets

(51) Int. Cl.

| | |
|---|---|
| ***F21V 21/30*** | (2006.01) |
| ***F21V 14/02*** | (2006.01) |
| ***F21V 29/83*** | (2015.01) |
| ***F21W 121/00*** | (2006.01) |
| ***F21Y 115/10*** | (2016.01) |

(52) U.S. Cl.
CPC ..... *F21V 29/83* (2015.01); *F21W 2121/00* (2013.01); *F21Y 2115/10* (2016.08)

(56) References Cited

FOREIGN PATENT DOCUMENTS

| | | | | | |
|---|---|---|---|---|---|
| CN | 110131694 | A | | 8/2019 | |
| CN | 209688675 | U | | 11/2019 | |
| CN | 209839756 | U | | 12/2019 | |
| CN | 211289731 | U | | 8/2020 | |
| CN | 211600385 | U | | 9/2020 | |
| KR | 101405571 | | * | 6/2014 | ..... F21V 21/30 |
| KR | 101532728 | | * | 7/2015 | ..... F21V 14/02 |

OTHER PUBLICATIONS

English Translation, KR 101532728, Jul. 1, 2015; Moon (Year: 2015).*

International Search Report and English Translation cited in PCT/CN2021/077260, dated May 31, 2021, 7 pages.

* cited by examiner

ANGLE-ADJUSTED LAMP

RELATED APPLICATIONS

This application is a continuation of and claims priority to PCT patent application number PCT/CN2021/077260, filed Feb. 22, 2021, which claims priority to Chinese patent application number 202020206221.5, filed on Feb. 25, 2020. PCT patent application number PCT/CN2021/077260 and Chinese patent application number 202020206221.5 are incorporated herein by reference.

FIELD OF THE DISCLOSURE

The present disclosure relates to an angle-adjustable lamp.

BACKGROUND OF THE DISCLOSURE

Existing light-emitting lamps, such as Chinese patent number CN103527963, comprise a lamp holder and a drive circuit board. The drive circuit board is disposed on the lamp holder. The drive circuit board comprises six rectangular panels and a circular panel. The six rectangular panels are enclosed to define a cylindrical structure. One end of the cylindrical structure is fixed on the lamp holder, and the circular panel is fixed on the other end of the cylindrical structure. The six rectangular panels and the circular panel are evenly disposed with light-emitting diode (LED) light sources. The LED light sources are arranged in a corn-shaped arrangement, which solves the problem that a single LED light source has a limited light-emitting angle to enable the LED light sources to achieve 360° light output, and light distribution is more uniform. However, the LED light sources emit uniform light, have no focus, and cannot be adjusted for positions that require more illumination, and the light emission is limited.

BRIEF SUMMARY OF THE DISCLOSURE

The present disclosure provides an angle-adjustable lamp configured to be adjusted to illuminate key locations according to a user's needs.

In order to solve the technical problem, a technical solution of the present disclosure is as follows.

An angle-adjustable lamp comprises a lamp body, a plurality of heat sinks, a plurality of connecting rods, and a plurality of light-transmitting covers. The plurality of heat sinks are rotatably connected to a side wall of the lamp body respectively through the plurality of connecting rods. The plurality of heat sinks are rotationally symmetrically disposed around a longitudinal center axis of the lamp body. Each of the plurality of light-transmitting covers is disposed on a side of a corresponding one of the plurality of heat sinks facing away from the lamp body. When the plurality of heat sinks are rotated around the plurality of connecting rods, an angle between each of the plurality of light-transmitting covers and the lamp body is correspondingly changed, so that a light exit angle of light transmitted through each of the plurality of light-transmitting covers is correspondingly changed.

In a preferred embodiment, positions of the side wall of the lamp body respectively corresponding to the plurality of heat sinks are respectively disposed with two lugs, and a side of each of the plurality of heat sinks facing the lamp body has a connecting member. The two lugs and the connecting member respectively comprise a position-providing hole, and each of the plurality of connecting rods is configured to pass through the position-providing holes of the two lugs and the connecting member and is connected to a plug.

In a preferred embodiment, a surface of each of the plurality of heat sinks comprises a grid-shaped heat dissipation hole.

In a preferred embodiment, the plurality of heat sinks are two, three, four, or five heat sinks, which are rotationally symmetrically disposed around the longitudinal center axis of the lamp body.

In a preferred embodiment, the plurality of heat sinks are three heat sinks, and the three heat sinks are sector-shaped. An inner edge of each of the three heat sinks comprises a position-providing arc. The three heat sinks are spaced from each other in a circumferential direction of the lamp body. Each of the three heat sinks is integrally formed with a mounting groove, and a light-emitting diode (LED) light source board and a corresponding one of the plurality of light-transmitting covers are sequentially assembled in the mounting groove.

In a preferred embodiment, the three heat sinks are configured to be rotated to different positions relative to the lamp body to form a planar light source, an elevation light source, or a multi-faceted light source.

In a preferred embodiment, a positioning block is disposed on an edge of the mounting groove of each of the three heat sinks, a positioning groove is defined on the LED light source board, and each of four corners of each of the plurality of light-transmitting covers is disposed with a positioning column.

Compared with the existing techniques, the technical solution has the following advantages.

The angle-adjustable lamp of the present disclosure can be freely adjusted by rotating the plurality of heat sinks for places that require more light irradiation at other angles, thereby changing an angle between the plurality of light-transmitting covers and the lamp body. For example, in the exhibition hall, some places require more light to murals on the wall, and some places only need more light to enable passage of visitors, which can be achieved by adjusting the angle of the angle-adjustable lamp. In this way, under the premise of 360° light output, the free adjustment of the key lighting area can be realized.

DETAILED DESCRIPTION OF THE EMBODIMENTS

Figure 1:
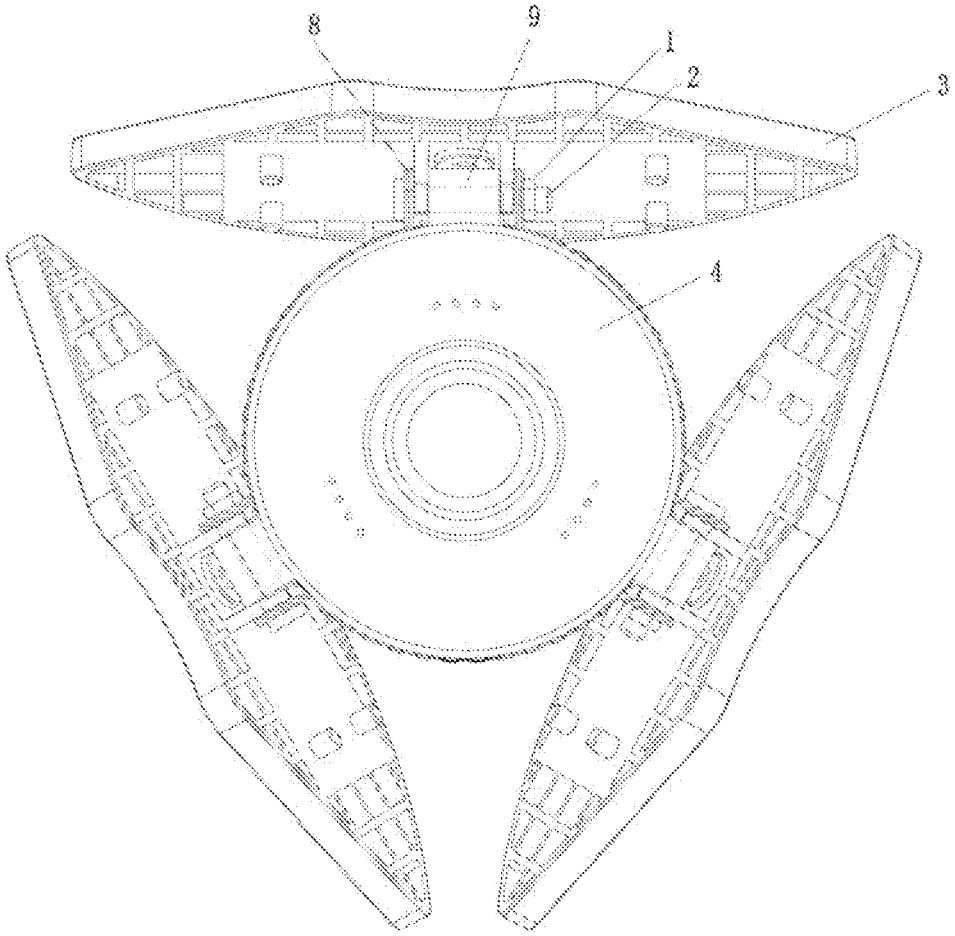
FIG. 1 illustrates a top view of an angle-adjustable lamp in Embodiment 1.
Figure 2:
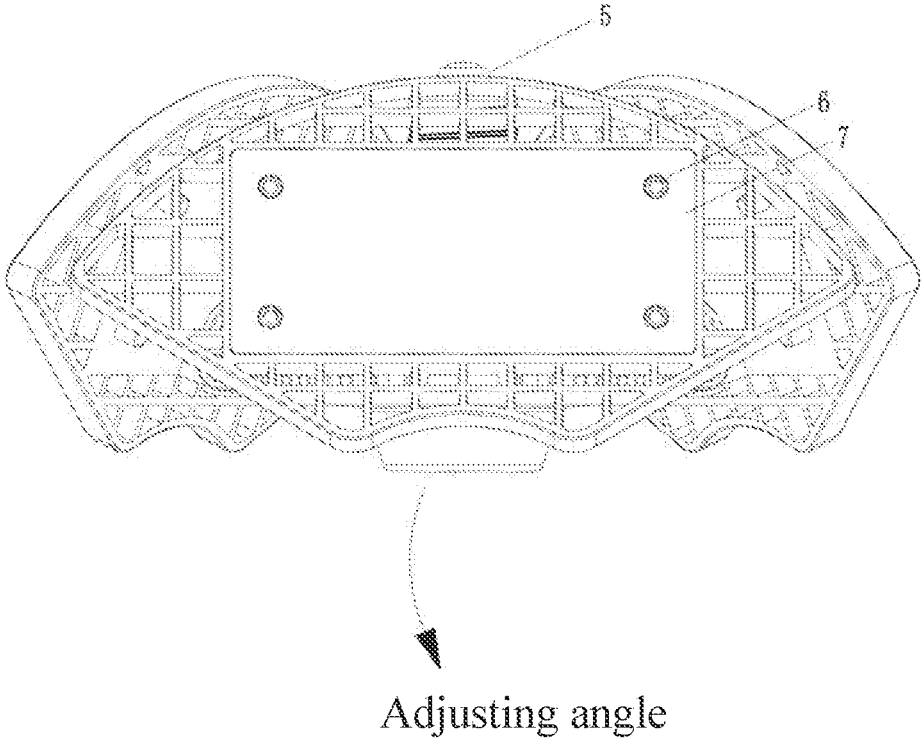
FIG. 2 illustrates a front view of the angle-adjustable lamp in Embodiment 1.
Figure 3:
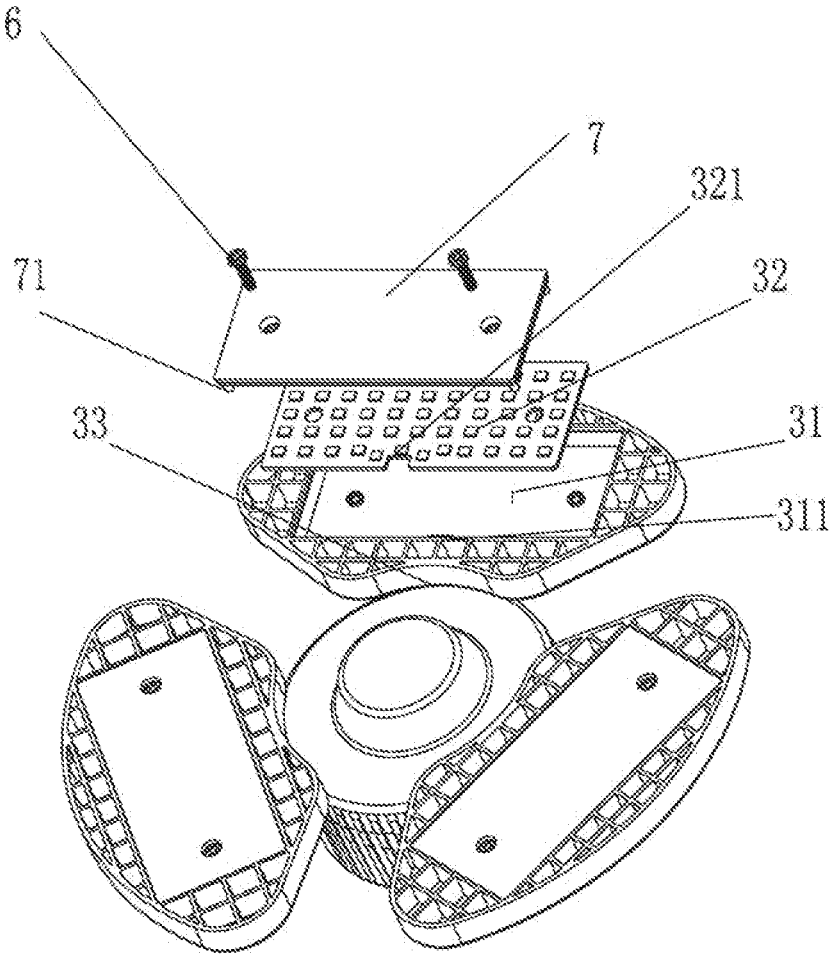
FIG. 3 illustrates a partial exploded view of the angle-adjustable lamp in Embodiment 1.

The present disclosure will be further described below in combination with the accompanying drawings and embodiments.

Embodiment 1

Referring to FIGS. 1 to 4, an angle-adjustable lamp is illustrated and comprises a lamp body 4, a plurality of heat sinks 3, a plurality of connecting rods 2, and a plurality of light-transmitting covers 7.

The plurality of heat sinks 3 are rotatably connected to a side wall of the lamp body 4 respectively through the plurality of connecting rods 2, and the plurality of heat sinks 3 are rotationally symmetrically disposed around a longitudinal center axis of the lamp body 4.

Each of the plurality of light-transmitting covers 7 is disposed on a side of a corresponding one of the plurality of heat sinks 3 facing away from the lamp body 4. When the plurality of heat sinks 3 are rotated around the plurality of connecting rods 2, an angle between each of the plurality of light-transmitting covers 7 and the lamp body 4 is changed correspondingly, so that a light exit angle of light transmitted through each of the plurality of light-transmitting covers 7 is also changed correspondingly.

In order to achieve a rotating connection between the lamp body 4 and each of the plurality of heat sinks 3, positions of the side wall of the lamp body 4 respectively corresponding to the plurality of heat sinks 3 are respectively disposed with two lugs 8, and a side of each of the plurality of heat sinks 3 facing the lamp body 4 has a connecting member 9. The two lugs 8 and the connecting member 9 respectively comprise a position-providing hole. Each of the plurality of connecting rods 2 passes through the position-providing holes of the two lugs 8 and the connecting member 9 and is connected to a plug 1.

In this embodiment, a surface of each of the plurality of heat sinks 3 comprises a grid-shaped heat dissipation hole.

In this embodiment, the plurality of heat sinks 3 are three heat sinks 3. The three heat sinks 3 are sector-shaped. An inner edge of each of the three heat sinks 3 comprises a position-providing arc 33, and the three heat sinks 3 are spaced from each other in a circumferential direction of the lamp body 4 to facilitate a rotation of the three heat sinks 3.

Each of the plurality of heat sinks 3 is integrally formed with a mounting groove 31. A light-emitting diode (LED) light source board 32 and a corresponding one of the plurality of light-transmitting covers 7 are sequentially assembled in the mounting groove 31, and the mounting groove 31, the LED light source board 32, and the corresponding one of the plurality of light-transmitting covers 7 are fixed together through screws 6. For ease of installation, a positioning block 311 is disposed on an edge of the mounting groove 31, and a positioning groove 321 is defined on the LED light source board 32. Each of four corners of each of the plurality of light-transmitting covers 7 is disposed with a positioning column 71.

Figure 4:
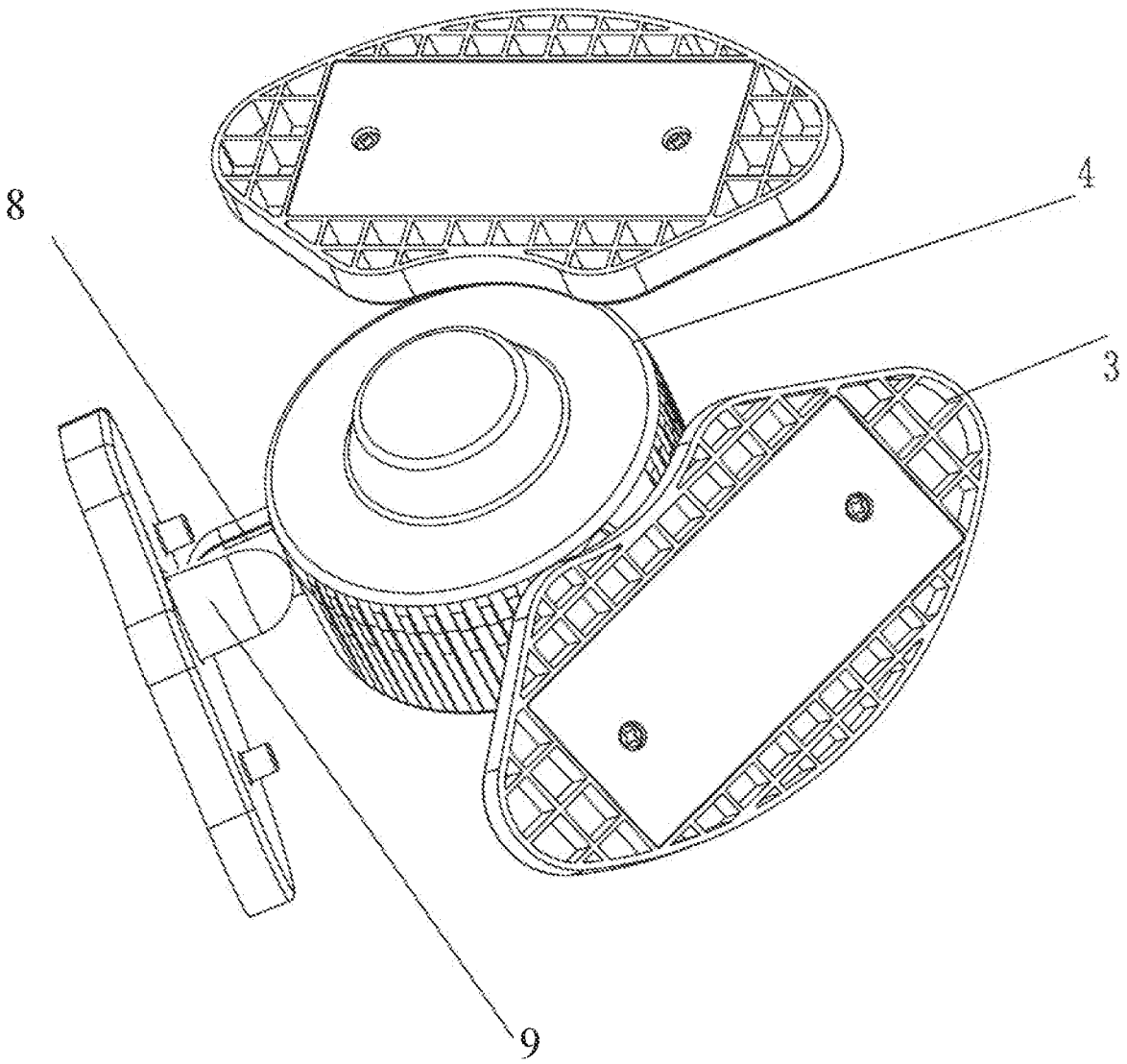
FIG. 4 illustrates a perspective view of the angle-adjustable lamp in Embodiment 1, when one of a plurality of heat sinks is in a folded state.

In this embodiment, the three heat sinks 3 can be rotated to different positions relative to the lamp body 4 to form a planar light source (see FIG. 3), an elevation light source (see FIG. 2), or a multi-faceted light source (see FIG. 4).

The angle-adjustable lamp of the present disclosure can be freely adjusted by rotating the plurality of heat sinks 3 for places that require more light irradiation at other angles, thereby changing angles between the plurality of light-transmitting covers 7 and the lamp body 4. For example, in the exhibition hall, some places require more light to murals on a wall, and some places only need more light to enable passage of visitors, which can be achieved by adjusting the angle of the angle-adjustable lamp. In this way, under the premise of 360° light output, the free adjustment of the key lighting area can be realized.

Embodiment 2

Figure 5:
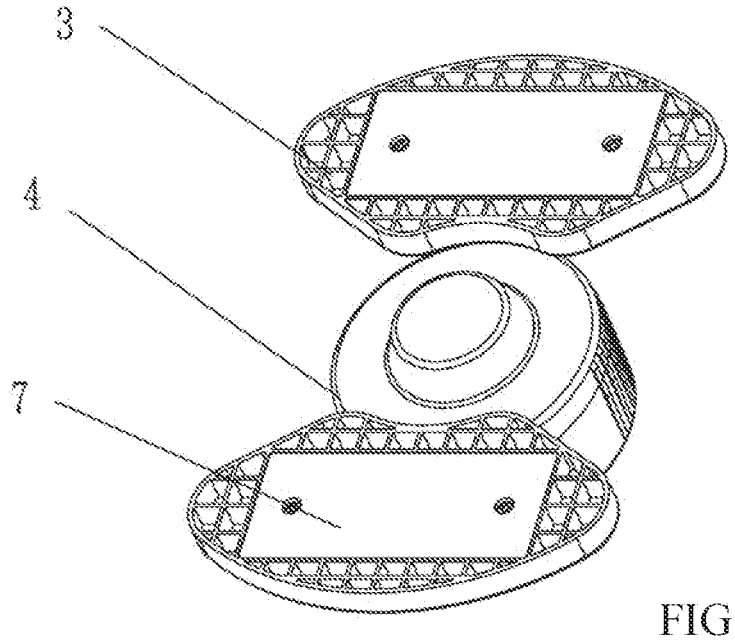
FIG. 5 illustrates a perspective view of an angle-adjustable lamp in Embodiment 2.

Referring to FIG. 5, the difference between an angle-adjustable lamp in Embodiment 2 and the angle-adjustable lamp in Embodiment 1 is described below. In this embodiment, the plurality of heat sinks 3 is two heat sinks 3, which are disposed rotationally symmetrically around the longitudinal center axis of the lamp body 4.

Embodiment 3

Figure 6:
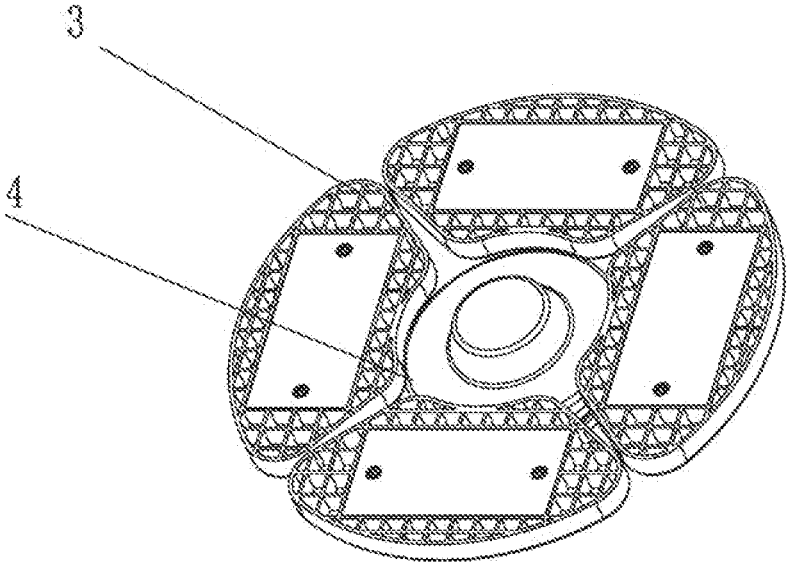
FIG. 6 illustrates a perspective view of an angle-adjustable lamp in Embodiment 3.

Referring to FIG. 6, the difference between an angle-adjustable lamp in Embodiment 3 and the angle-adjustable lamp in Embodiment 1 is described below. In this embodiment, the plurality of heat sinks 3 are four heat sinks 3, which are disposed rotationally symmetrically around the longitudinal center axis of the lamp body 4.

The plurality of heat sinks 3 of the angle-adjustable lamp of the present disclosure can be two, three, four, or five heat sinks 3. A lamp holder 5 may be a screw-on type or a snap-on type.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. An angle-adjustable lamp, comprising:

a lamp body, three heat sinks, a plurality of connecting rods, and a plurality of light-transmitting covers, wherein:

the three heat sinks are rotatably connected to a side wall of the lamp body respectively through the plurality of connecting rods, the three heat sinks are rotationally symmetrically disposed around a longitudinal center axis of the lamp body, each of the plurality of light-transmitting covers is disposed on a side of a corresponding one of the three heat sinks facing away from the lamp body, a surface of each of the three heat sinks comprises a grid-shaped heat dissipation hole, the three heat sinks are sector-shaped, an inner edge of each of the three heat sinks comprises a position-providing arc, the three heat sinks are spaced apart from each other in a circumferential direction of the lamp body, each of the three heat sinks is integrally formed with a mounting groove, a light-emitting diode (LED) light source board and a corresponding one of the plurality of light-transmitting covers are sequentially assembled in the mounting groove, a positioning block is disposed on an edge of the mounting groove of each of the three heat sinks, a positioning groove is defined on the LED light source board, each of four corners of each of the plurality of light-transmitting covers is disposed with a positioning column, and when the three heat sinks are rotated around the plurality of connecting rods, an angle between each of the plurality of light-transmitting covers and the lamp body is correspondingly changed, so that a light exit angle of light transmitted through each of the plurality of light-transmitting covers is correspondingly changed.

2. The angle-adjustable lamp according to claim 1, wherein:

positions of the side wall of the lamp body respectively corresponding to the three heat sinks are respectively disposed with two lugs, a side of each of the three heat sinks facing the lamp body has a connecting member, the two lugs and the connecting member respectively comprise a position-providing hole, and each of the plurality of connecting rods is configured to pass through the position-providing holes of the two lugs and the connecting member and is connected to a plug.

3. The angle-adjustable lamp according to claim 2, wherein:

the three heat sinks are configured to be rotated to different positions relative to the lamp body to form a planar light source, an elevation light source, or a multi-faceted light source.

4. The angle-adjustable lamp according to claim 1, wherein:

the three heat sinks are configured to be rotated to different positions relative to the lamp body to form a planar light source, an elevation light source, or a multi-faceted light source.

5. An angle-adjustable lamp, comprising:

a lamp body, three heat sinks, a plurality of connecting rods, and a plurality of light-transmitting covers, wherein:

the three heat sinks are rotatably connected to a side wall of the lamp body respectively through the plurality of connecting rods, the three heat sinks are rotationally symmetrically disposed around a longitudinal center axis of the lamp body, each of the plurality of light-transmitting covers is disposed on a side of a corresponding one of the three heat sinks facing away from the lamp body, positions of the side wall of the lamp body respectively corresponding to the three heat sinks are respectively disposed with two lugs, a side of each of the three heat sinks facing the lamp body has a connecting member, the two lugs and the connecting member respectively comprise a position-providing hole, each of the plurality of connecting rods is configured to pass through the position-providing holes of the two lugs and the connecting member and is connected to a plug, the three heat sinks are sector-shaped, an inner edge of each of the three heat sinks comprises a position-providing arc, the three heat sinks are spaced apart from each other in a circumferential direction of the lamp body, each of the three heat sinks is integrally formed with a mounting groove, a light-emitting diode (LED) light source board and a corresponding one of the plurality of light-transmitting covers are sequentially assembled in the mounting groove, a positioning block is disposed on an edge of the mounting groove of each of the three heat sinks, a positioning groove is defined on the LED light source board, each of four corners of each of the plurality of light-transmitting covers is disposed with a positioning column, and when the three heat sinks are rotated around the plurality of connecting rods, an angle between each of the plurality of light-transmitting covers and the lamp body is correspondingly changed, so that a light exit angle of light transmitted through each of the plurality of light-transmitting covers is correspondingly changed.

* * * * *